US009382870B2

(12) United States Patent
Reinhart et al.

(10) Patent No.: US 9,382,870 B2
(45) Date of Patent: Jul. 5, 2016

(54) COMPRESSION BOSS FOR ENGINE FRONT COVER

(71) Applicant: Ford Global Technologies, LLC, Dearborn, MI (US)

(72) Inventors: Paul Thomas Reinhart, Livonia, MI (US); Chad Strimpel, Maybee, MI (US); JonCarlo Mancini, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 8 days.

(21) Appl. No.: 14/048,395

(22) Filed: Oct. 8, 2013

(65) Prior Publication Data

US 2015/0096525 A1 Apr. 9, 2015

(51) Int. Cl.

| | |
|---|---|
| ***F02B 77/00*** | (2006.01) |
| ***F01M 9/10*** | (2006.01) |
| ***F02B 77/04*** | (2006.01) |
| ***B65D 45/16*** | (2006.01) |
| ***F02F 7/00*** | (2006.01) |

(52) U.S. Cl.

CPC ..... *F02F 7/0082* (2013.01); *F02B 2275/34* (2013.01); *F02F 7/0026* (2013.01); *Y10T 29/49231* (2015.01)

(58) Field of Classification Search

CPC F01M 11/0004; F01M 13/0416; F02F 7/006; F02B 77/13; F02B 2275/34; F02B 63/02; F02M 35/024; F01P 11/0214

See application file for complete search history.

(56) References Cited

U.S. PATENT DOCUMENTS

| | | | | |
|---|---|---|---|---|
| 3,223,197 | A * | 12/1965 | Conover | F01M 1/02 184/104.3 |
| 4,027,644 | A * | 6/1977 | Timour | F02B 75/22 123/195 C |
| 4,729,351 | A | 3/1988 | Nishimura et al. | |
| 5,245,961 | A * | 9/1993 | Miyakubo | B60K 5/1216 123/195 C |
| 7,617,811 | B2 * | 11/2009 | Neu | F02F 7/0046 123/195 A |
| 7,631,630 | B2 | 12/2009 | Sedlar et al. | |
| 2012/0103720 | A1 | 5/2012 | Sugiyama et al. | |
| 2012/0199096 | A1 | 8/2012 | Mikami et al. | |

FOREIGN PATENT DOCUMENTS

JP 7259578 A 10/1995

OTHER PUBLICATIONS

Bohacz, "Machine Shop Basics—The Cylinder Head", Popular Hot Rodding, Feb. 2009, 2 pages.

* cited by examiner

*Primary Examiner* — Lindsay Low
*Assistant Examiner* — Syed O Hasan
(74) *Attorney, Agent, or Firm* — Greg P. Brown; Brooks Kushman P.C.

(57) ABSTRACT

An apparatus is provided having two mating components. The mating components include an engine and an engine front cover. A fastening boss is formed on at least one of the two mating components and configured to receive a threaded fastener to join the two mating components. A compression boss extends from a first of the two mating components to contact a second of the two mating components. The compression boss is dimensioned relative to the fastening boss to create compressive loading in the compression boss when the threaded fastener is tightened to join the mating components.

15 Claims, 4 Drawing Sheets

COMPRESSION BOSS FOR ENGINE FRONT COVER

TECHNICAL FIELD

The disclosure relates to mounting an engine front cover to an engine and integrated structural features to facilitate the same.

BACKGROUND

Combustion engines may include engine front covers which attach to the engine or an engine component such as a cylinder block or cylinder head. Structural bosses or fastening bosses may be used to assist in facilitating the attachment. Engine accessories may be attached to the engine front cover. Available space in the engine and surrounding environment may determine the configuration and positioning of these bosses and engine accessories.

SUMMARY

An apparatus includes two mating components including an engine and a front cover. A fastening boss is formed on at least one of the two mating components and configured to receive a threaded fastener to join the two mating components. A compression boss extends from a first of the two mating components to contact a second of the two mating components. The compression boss is dimensioned relative to the fastening boss to create compressive loading in the compression boss when the threaded fastener is tightened to join the two mating components. The compression boss may define a nominal height and tolerance configured to create an interference at the contact. The compression boss may also define a receiving aperture at an upper portion of the compression boss configured to receive an engine accessory. The engine accessory may be an engine mount. The contact between the compression boss and one of the mating components may define an interference equaling a compressive force sufficient to generate a positive clamp load at the contact during operating conditions. A tolerance stack may be configured to maintain the compressive loading under stacked conditions. The engine front cover may define the compression boss at a substantially central area of the engine front cover. The engine front cover may also define the fastening boss at a perimeter of the engine front cover.

An apparatus includes a front cover and an engine. The front cover includes a fastening boss and a compression boss. The engine includes a threaded aperture to receive a fastener through the fastening boss to join the front cover and engine. The compression boss contacts the engine when the front cover and engine are joined. The compression boss is dimensioned to create compressive loading therein when the fastener is tightened. The compression boss may define a nominal height and tolerance configured to create an interference at the contact with the engine when the front cover and engine are joined. The compression boss may define a receiving aperture at an upper portion of the compression boss configured to receive an engine accessory, which may include an engine mount. The contact between the compression boss and engine may define an interference equaling a compressive force sufficient to generate a positive clamp load at the contact during operating conditions. High and low dimensions of the front cover and engine may define a tolerance stack configured to maintain the compressive loading under stacked conditions.

A method includes securing a fastener through a fastening boss formed on at least one of two mating components to join the two mating components. The method also includes placing a compression boss formed on a first of the two mating components into compressive contact with a surface of a second of the mating components. The mating components include a front cover and an engine. The method may also include securing an engine accessory to a receiving aperture positioned at an upper portion of the compression boss.

DETAILED DESCRIPTION

Figure 1:
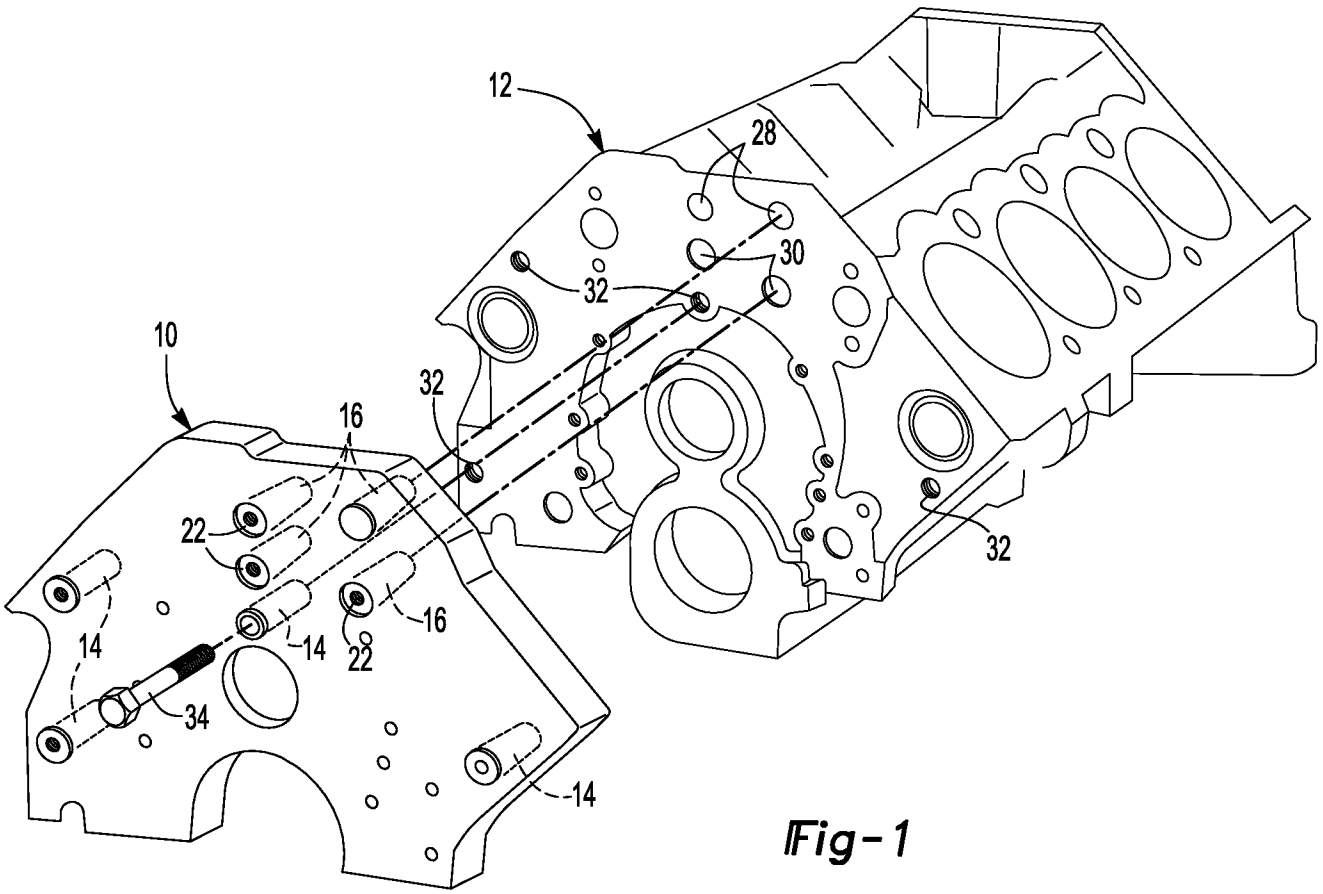
FIG. 1 is a perspective view of an engine and an engine front cover showing a mating alignment of bosses.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Bosses may be used as fastening points to mate components and parts. In an engine environment, fastening bosses and/or structural bosses may be used to assist in joining or attaching two mating components such as the engine front cover and the engine. This type of fastening boss may be cylindrically shaped and formed on one of the mating components. For example, the fastening boss may extend from the engine cover and include a through-hole which may optionally be partially threaded. The through-hole may be configured to align with a threaded receiving aperture of the engine such that a fastener, for example a screw or bolt, may attach the engine front cover to the engine. The mating component which includes the receiving aperture requires a sufficient amount of material to provide for an appropriate depth of the receiving aperture. The appropriate depth may be difficult to obtain at certain portions of the engine due to other engine components and other components positioned in the engine environment. This difficulty may limit options available for utilizing fastening bosses.

A compression boss may be used in combination with one or more fastening bosses to create compressive loading forces. The compression boss may be formed on one of the mating components and configured to contact a receiving surface of the other mating component when the fastening boss or fastening bosses join or attach the two mating components. The compressive loading may be maintained through proper positioning of the compression bosses and the fastening bosses. Dimensional configurations of the compression boss and receiving surface may assist in providing the compressive loading forces. The compression and fastening bosses may also assist in reducing undesired noise and/or vibrations generated by operation of the engine.

Front wheel drive automotive engines may use engine/motor mounts that fasten and/or are integrated into an engine front cover to support the engine in an east-west configuration. The engine mount may be used to connect the engine to the frame and may be made of rubber and metal. The metal portion may connect to the engine or engine front cover on one side and to the frame on the other. The engine front cover is a housing typically made of sheet metal or cast aluminum that covers, for example, a timing chain or gears. During operation of the engine, an engine cylinder block and/or cylinder heads may create undesirable vibration and/or noise that may travel into the engine front cover. The rubber portions of engine mounts may act as isolators to assist in holding the engine in place while absorbing the vibrations and/or noise. An engine mount may also be integrated into the engine cover via a compression boss or casting as described below.

Figure 2:
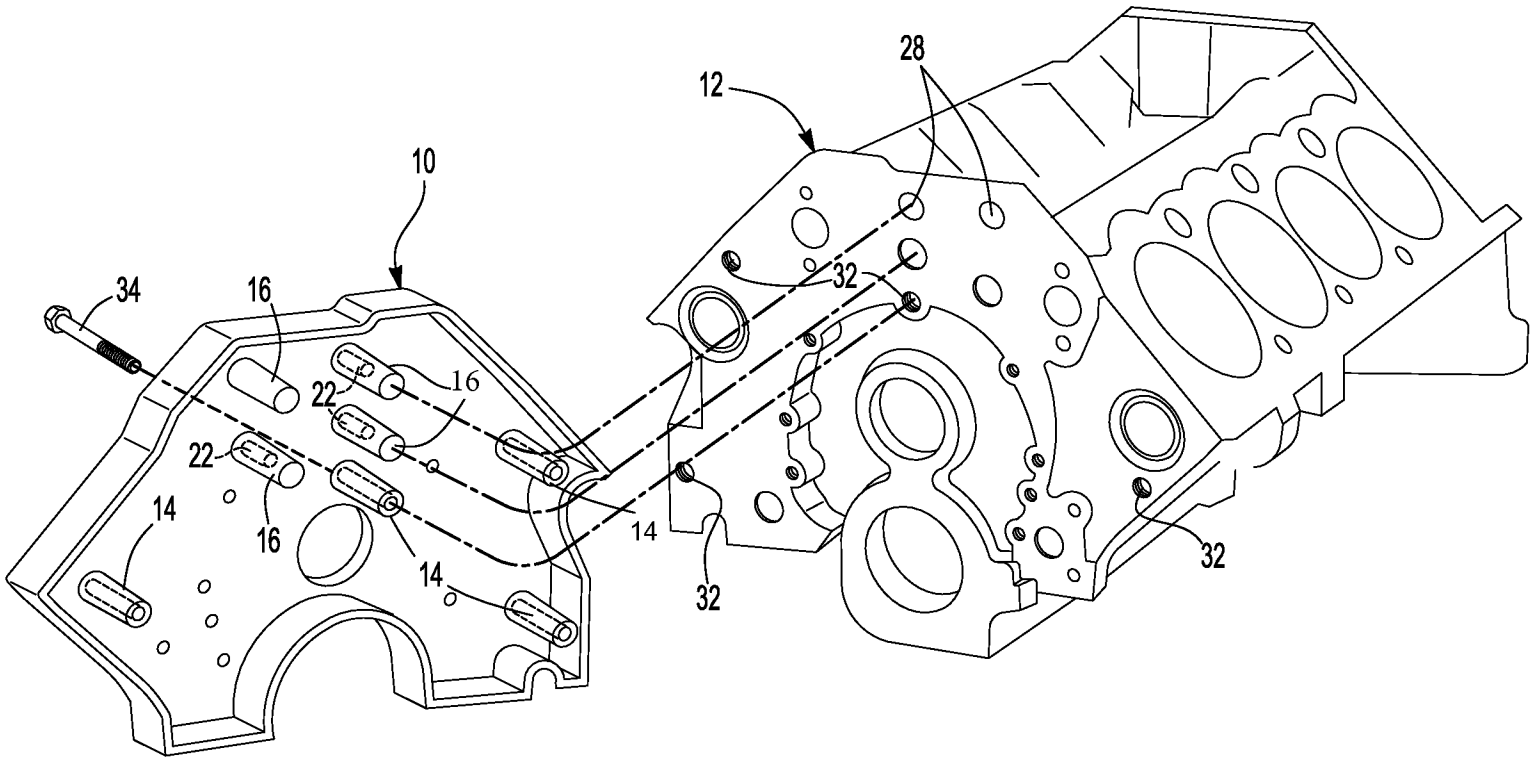
FIG. 2 is a perspective view of an engine and a rear perspective view of an engine front cover.

Referring now to FIGS. 1 and 2, an illustrative engine front cover 10 and engine 12 are shown which may be referred to as mating components herein. The engine front cover 10 may include one or more fastening bosses 14 and one or more compression bosses 16. The fastening boss 14 may also be referred to as a structural boss. Both the fastening boss 14 and the compression boss 16 may be formed on the engine front cover 10 by, for example, casting. Alternatively and/or additionally, under certain packaging conditions the fastening bosses 14 and the compression bosses 16 may be formed on the engine 12 though the engine front cover 10 may be preferred. The fastening boss 14 may include a through-hole for receiving a fastener. One or more fastening bosses 14 may additionally and/or optionally be positioned at regions of the engine front cover 10 including the central and perimeter regions. The compression boss 16 may be cast as a solid unit or may optionally include a receiving cavity 22. Engine 12 accessories may be mounted to the receiving cavity 22 as further described below.

The engine 12 may include a cylinder block, a cylinder head, receiving surfaces, receiving apertures, and other components. The cylinder block may include cylinders of the engine 12. The cylinder head may be bolted to the top of the engine 12 and include a gasket therebetween. The receiving surfaces may be positioned at different locations on the engine 12 and have different characteristics depending on a desired use. For example, receiving surface 28 may be positioned near a substantially central region of the engine 12 and include a surface flush or substantially flush with the surrounding engine 12 surface. Receiving surface 30 may be positioned at or near a substantially central region of the engine 12 and include a surface at a depth slightly below the surrounding engine 12 surface. The receiving surfaces may also be positioned on the cylinder block, cylinder head and/or in alignment with a corresponding compressive boss.

The receiving apertures may align with a corresponding fastening boss, be positioned at different locations on the engine 12, and have different characteristics depending on the desired use. For example, receiving aperture 32 may be positioned at or near a substantially central region of the engine 12. Additional receiving apertures may also be positioned in locations corresponding to the fastening bosses 14 which may be positioned along the perimeter of the engine front cover 10.

Figure 3:
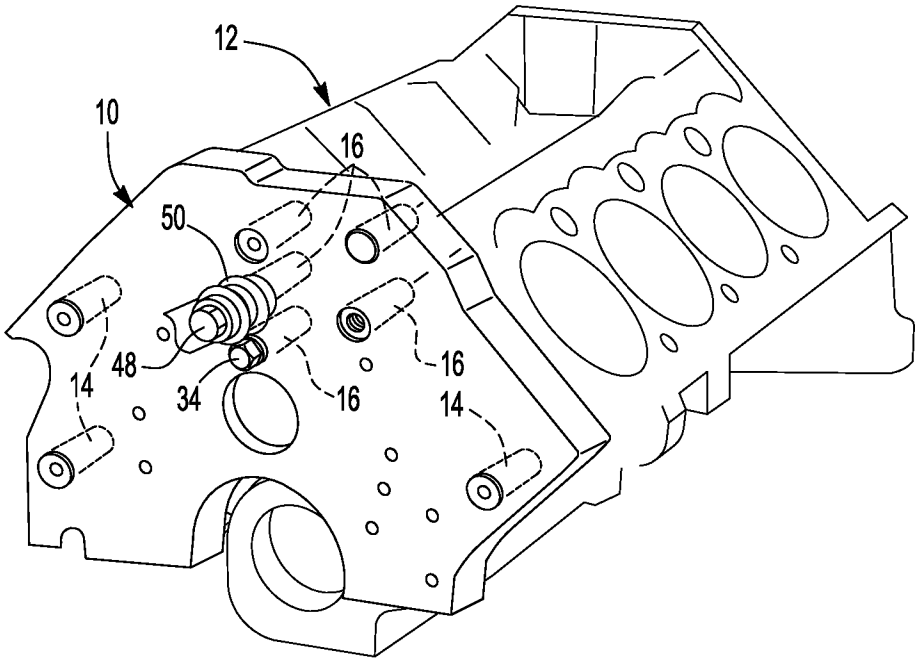
FIG. 3 is a perspective view of an engine front cover mounted to an engine.
Figure 4:
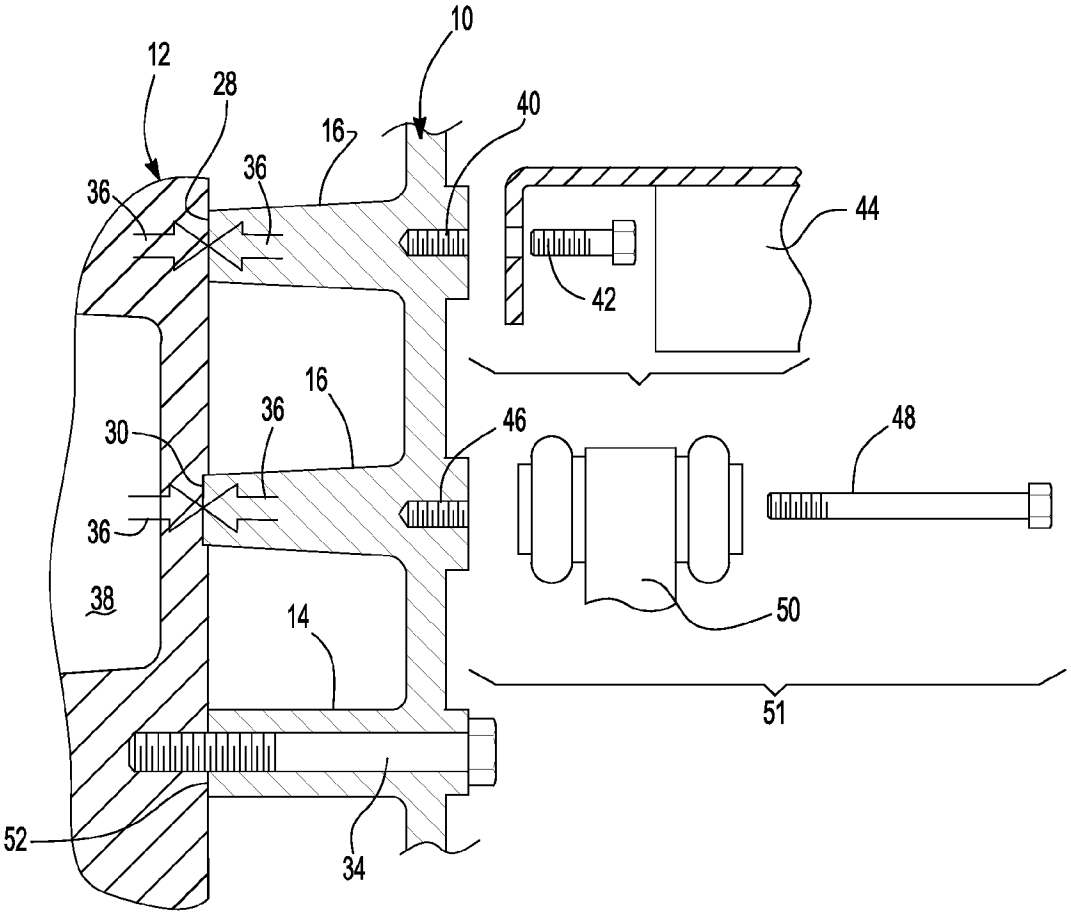
FIG. 4 is a partial side view, in cross-section, of FIG. 3 showing two compression bosses in contact with a surface of the engine and a fastening boss mated to the engine.

Referring now to FIGS. 3 and 4, the one or more fastening bosses 14 and one or more compression bosses 16 may assist in securing and/or attaching the engine front cover 10 to the engine 12. The fastening bosses 14 may mate with corresponding receiving apertures 32. As one example, a threaded bolt, such as fastener 34, may be inserted into the fastening boss 14 and mate with a threaded portion of the receiving aperture 32. Other fasteners are available. As the fastener 34 mates with the receiving aperture 32, the compression bosses 16 may contact receiving surfaces of the engine 12 such as receiving surface 28 and receiving surface 30. Dimensional configurations of the compression bosses 16 and the respective surfaces 28 and 30 may create compressive forces in the compression bosses 16 once the fastener 34 is secured. Force arrows 36 show these compressive forces at the contact between the compression bosses 16 and the respective receiving surfaces 28 and 30. As such, dimensional configurations for compression bosses and opposing surfaces may combine with fastening bosses to create interference at the contact regions and thus create compressive forces. Examples of dimensional configurations may include machined tolerance conditions and/or stacks to ensure that compressive loading and/or a positive clamp load may occur under various operating conditions. The interference may be calculated based on manufacturing and machining characteristics of the mating components. Additionally and/or optionally, a tolerance stack may be used to ensure that compressive loads between the engine front cover 10 and engine 12 are maintained under various stacked conditions. For example, high and low dimensions on each of the mating components may be examined to insure an interference occurs in accordance with the manufacturing and machining characteristics.

As mentioned above, available space in an engine environment is often limited which may create issues for mounting engine front covers, engine accessories and/or other components. This may be of particular concern when the cover, accessory and/or component require a fastener for securing to a portion of the engine where there is not enough material available for a receiving aperture and/or bore. For example and continuing to refer to FIG. 4, the engine 12 may include a cavity 38 which limits available boring depth in the adjacent area. Here, a typical fastener and fastening boss combination may not be feasible, however the compression boss 16 may assist in providing desired structural support without requiring a receiving aperture in the engine 12.

Additionally, the compression boss 16 may also include a threaded aperture to receive a fastener to provide an option for mounting engine accessories and/or other components. As shown in FIG. 4, a threaded aperture 40 may be positioned at an upper portion of the compression boss 16 to receive fastener 42 and facilitate mounting an engine accessory 44 to the engine front cover 10. As another example, an engine mount system 51 may be integrated with the engine front cover 10. The engine mount system 51 may provide one or more structural attachment points to connect the engine 12 to a vehicle frame (not shown). For example, an engine side of the system 51 may include a threaded aperture 46 to operate as a structural attachment point. A vehicle side of the system 51 may include mount 50 which may be fastened to threaded aperture 46 via fastener 48. The system 51 may support the engine 12 under static and dynamic loading from the engine 12 and assist in mitigating engine 12 generated noise and vibration into the vehicle frame. The compression boss 16 used to support engine mount system 51 may be particularly useful for front wheel drive vehicles which may use such an integrated structure to support the engine 12 in an east-west configuration. In another example, an engine mount system and the engine front cover may be casted together and utilize advantages of the compression bosses described herein.

For example, fastening bosses may also be associated with leak paths for engine and transmission oil due to the fastener and receiving aperture. Therefore, replacing one or more fastening bosses with one or more compression bosses may eliminate such leak paths. Overall engine weight may also be reduced with fewer fasteners required for assembly. Fewer fasteners may also drive reduced assembly times. When compared with fastening bosses, compression bosses may also improve noise, vibration and harshness ("NVH") characteristics resulting from engine operation.

Figure 5:
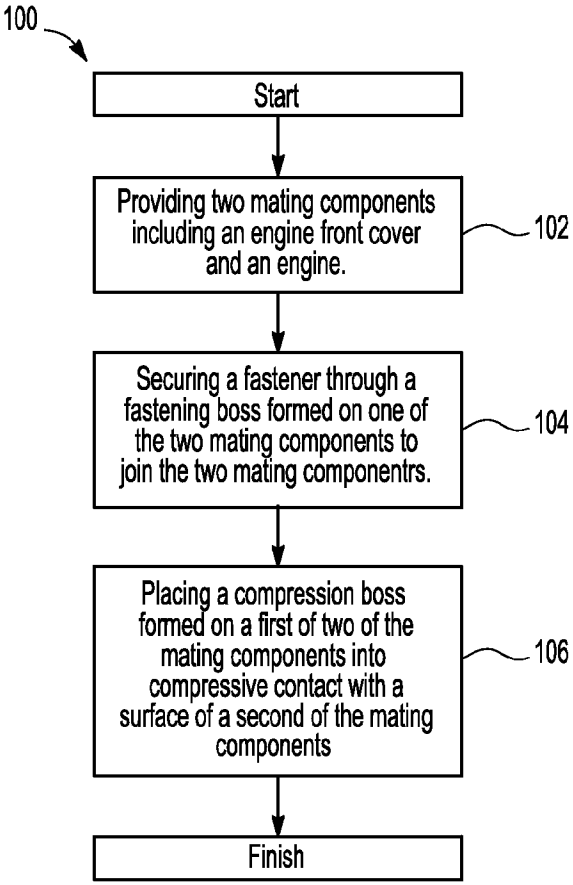
FIG. 5 is a flow chart of a method for creating compressive loads between two mating components.

Now referring to FIG. 5, a method is generally indicated by reference numeral 100. Operation 102 may include providing two mating components, for example the engine front cover 10 and the engine 12, cylinder block or cylinder head. In operation 104, a fastening boss 14 formed on a first of the two mating components may be secured to a second of the two mating components by a fastener. For example, a fastener 34 may be inserted into the fastening boss 14 of the engine front cover 10 and mate with the receiving aperture 32 of the engine 12. As described above, one or both of the two mating components may also include a compression boss 16 formed thereon. In operation 106, the compression boss 16 of one of the mating components may place a compressive contact to a surface, such as receiving surface 28 or 30, of the other mating component when the fastener 34 is tightened. As such and in response to joining the two mating components, opposing compressive loads may be created within the compression boss 16 and at the contact between the compression boss 16 and respective receiving surface. As mentioned above, the engine 12 and engine front cover 10 may be described as mating components herein. Additionally and/or alternatively, it may be desirable to secure the engine front cover 10 to the cylinder block and cylinder head. In these scenarios, the cylinder block or cylinder head may be considered mating components.

Additional and/or optional configurations of the fastening boss and compression boss may be utilized with the method 100. For example, the compression boss 16 may be formed on the engine 12, cylinder block or cylinder head. In these examples, the receiving surface may be formed on the engine front cover 10. As another example, the engine 12, cylinder block or cylinder head may include a fastening boss with a threaded receiving cavity. In these examples, the engine front cover 10 may include a through hole for inserting a fastener to mate with the threaded receiving cavity of the fastening boss.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. An apparatus comprising:

two mating components including a front cover and an engine block defining a receiving surface disposed at a depth below a primary surface of the engine block and a front cover;

a fastening boss formed on at least one of the two mating components and configured to receive a threaded fastener to join the two mating components; and a compression boss defining a receiving aperture extending partially therein at an upper portion thereof and the compression boss extending from the front cover to contact the receiving surface and sized relative to the fastening boss to create compressive loading in the compression boss when the fastener is tightened to join the two mating components.

2. The apparatus of claim 1, wherein the compression boss defines a nominal height and tolerance configured to create an interference at the contact with the other of the components.

3. The apparatus of claim 1, wherein the receiving aperture is sized to receive an engine accessory.

4. The apparatus of claim 3, wherein the engine accessory is an engine mount.

5. The apparatus of claim 1, wherein the contact defines an interference equaling a compressive force sufficient to generate a positive clamp load at the contact during operating conditions.

6. The apparatus of claim 1, wherein the two mating components further include a tolerance stack configured to maintain the compressive loading under stacked conditions.

7. The apparatus of claim 1, wherein the one of the components defines the compression boss at a central area thereof and above a region sized to receive a crank shaft.

8. The apparatus of claim 7, wherein the one of the components defines the fastening boss at a perimeter thereof.

9. An apparatus comprising:

a front cover including a compression boss without a fastener element and a fastening boss; and an engine defining a receiving surface at a depth below a primary engine surface which does not facilitate mechanical fastening and including a threaded aperture to receive a fastener through the fastening boss to join the front cover and engine, the compression boss contacting the receiving surface when the front cover and engine are joined, the compression boss dimensioned to create compressive loading therein when the fastener is tightened, and the compression boss defining a receiving aperture extending partially therein at an upper portion of the compression boss to receive an engine accessory.

10. The apparatus of claim 9, wherein the compression boss defines a nominal height and tolerance configured to create an interference at the contact with the engine when the front cover and engine are joined.

11. The apparatus of claim 9, wherein the engine accessory is an engine mount.

12. The apparatus of claim 9, wherein the contact defines an interference equaling a compressive force sufficient to generate a positive clamp load at the contact during operating conditions.

13. The apparatus of claim 9, wherein high and low dimensions of the front cover and engine define a tolerance stack configured to maintain the compressive loading under stacked conditions.

14. A method comprising:

securing a fastener through a fastening boss formed on at least one of two mating components including a front cover and an engine to join the components and positioning a compression boss defining a receiving aperture extending partially therein at an upper portion and the compression boss formed on one of the components into compressive contact with a receiving surface at a depth below a primary surface of the other component.

15. The method of claim 14, further comprising securing an engine accessory to a receiving aperture positioned at an upper portion of the compression boss.

* * * * *